US005503858A

United States Patent [19]

Reskow

[11] Patent Number: 5,503,858

[45] Date of Patent: Apr. 2, 1996

[54] MOLDED PLASTIC OVERWRAP TRAY

[75] Inventor: Daniel W. Reskow, Long Valley, N.J.

[73] Assignee: Tekni-Plex Inc., Brooklyn, N.Y.

[21] Appl. No.: 166,707

[22] Filed: Dec. 13, 1993

[51] Int. Cl.[6] ..... B65D 85/00

[52] U.S. Cl. ..... 426/119; 426/106; 426/124; 426/129; 220/518; 220/659; 206/561; 206/564; 206/815; 206/557

[58] Field of Search ..... 426/119, 106, 426/124, 129, 396; 220/DIG. 6, 516, 518, 659, 902, 31; 206/471, 561, 564, 815, 557, 387; 53/449; 229/2.5 R

[56] References Cited

U.S. PATENT DOCUMENTS

| | | | |
|---|---|---|---|
| 3,074,582 | 1/1963 | Martelli | 229/2.5 R |
| 3,104,766 | 9/1963 | Bostrom | 229/2.5 R |
| 3,151,799 | 10/1964 | Engles, Jr. et al. | 229/2.5 R |
| 3,403,834 | 10/1968 | Donovan | 229/2.5 R |
| 3,420,431 | 1/1969 | Donovan | 229/2.5 R |
| 3,485,434 | 12/1969 | Donovan et al. | 229/2.5 R |
| 3,530,917 | 9/1970 | Donovan | 426/119 X |
| 3,563,445 | 2/1971 | Clayton | 229/2.5 R |
| 3,583,623 | 6/1971 | Golner et al. | 229/2.5 R |
| 3,710,975 | 1/1973 | Jansen | 220/31 S |
| 3,743,081 | 7/1973 | Roberg et al. | 206/387 |
| 3,777,881 | 12/1973 | Schwartz | 206/387 |
| 3,905,506 | 9/1975 | Florion | 229/2.5 R X |
| 5,018,623 | 5/1991 | Hrenyo | 206/557 |
| 5,078,266 | 1/1992 | Rackley | 206/815 X |
| 5,269,430 | 12/1993 | Schlaupitz et al. | 229/2.5 R X |

*Primary Examiner*—Donald E. Czaja
*Assistant Examiner*—Milton I. Cano
*Attorney, Agent, or Firm*—McAulay Fisher Nissen Goldberg & Kiel

[57] ABSTRACT

A molded plastic overwrap tray is disclosed having a base and sidewalls. The upper edges of the sidewalls define an upper surface of the tray. The base and sidewalls define a food retaining chamber. Adjacent sidewalls of the tray are connected to one another through a corner reinforcing rib extending from the base to the upper edges of the associated sidewalls. The reinforcing rib defines a channel in communication with the food retaining chamber to provide finger access to food positioned in the food retaining chamber to facilitate removal thereof. Each of the corner ribs provides reinforcement to resist deflection of the upper edges of the sidewalls, whereby an overwrap on the tray is supported by the upper surface of the tray to minimize sagging of the overwrap and prevent the overwrap from coming into contact with food in the food retaining chamber. In another embodiment, a center post is provided having its upper end substantially level with the upper surface of the tray. The post contacts the under surface of the overwrap and assists in preventing contact between the food and the overwrap upon stacking one tray on top of another.

10 Claims, 5 Drawing Sheets

MOLDED PLASTIC OVERWRAP TRAY

BACKGROUND OF THE INVENTION

I. Field of the Invention

This invention relates generally to a molded plastic overwrap tray, and in particular, to overwrap trays for use with the gas flush method of packaging meat patty products.

II. Description of the Prior Art

Molded plastic overwrap trays are commonly used in the meat processing industry. These trays are constructed from polystyrene foam and serve as a tray for the packaging of meat products. The trays, having meat placed thereon, are then sealed with an overwrap of transparent film.

The trays are generally rectangular in shape and made in a variety of sizes using thermo-forming machinery. The machinery and processes for manufacturing the trays are well known in the art. Recent advances in the gas flush method of packaging meat products, when used with the known meat packaging trays, result in prolonged shelf-life of the packaged meat products.

Packaged meat products using the known trays and the gas flush method, however, often exhibit visually objectionable discoloration. This discoloration results from contact between the meat product and the overwrap film, the tray, or other meat product. The discoloration has proven to negatively effect the sale of products wrapped using the conventional trays and the gas flush method.

Furthermore, stacking conventional meat packages both flattens the meat product and encourages contact between the overwrap film and the meat product wrapped therein. In addition, stacking packages of meat wrapped on conventional trays results in an unstable arrangement because an upper layer of packages rests upon the non-uniform and compressible meat product below.

In addition, there is a tendency for packaging machinery to wrap the overwrap so tightly over the conventional trays so as to cause distortion. More specifically, the tightly wrapped film tends to bow the sidewalls of the trays inwardly. This may result in cracking or breaking of the trays, particularly if the polystyrene foam is brittle.

The present invention improves on the trays known in the art by minimizing contact between the product contained and the overwrap film, minimizing tray breakage and maximizing stackability in the manner hereinafter described.

SUMMARY OF THE INVENTION

The invention provides for a plastic tray having a base and sidewalls. The base and sidewalls define a food retaining chamber. Each of the sidewalls has an upper edge. The upper edges of the sidewalls define an upper surface of the tray having four sides. Adjacent sides are interconnected by radial corners. The radial corners are formed having a reinforcing rib which extends along the sidewalls, at a position adjacent to the base, to the upper surface of the tray. The reinforcing rib provides a channel which communicates with the food retaining chamber of the tray. The channel provides finger or utensil access to food positioned in the food retaining chamber to facilitate removal thereof. The corner reinforcing ribs provide reinforcement to resist deflection of the upper edges of the sidewalls when a tightly-stretched, overwrap film is wrapped around the tray. The upper surface of the tray supports the overwrap film. Accordingly, sagging of the overwrap film, and thus, contact between the overwrap film and the packaged food product is minimized. In addition, damage or bowing of the tray is minimized.

Additional features and advantages of the present invention will become more apparent from a consideration of the following detailed description when taken in conjunction with the accompanying drawings.

DESCRIPTION OF THE PREFERRED EMBODIMENTS

Figure 1:
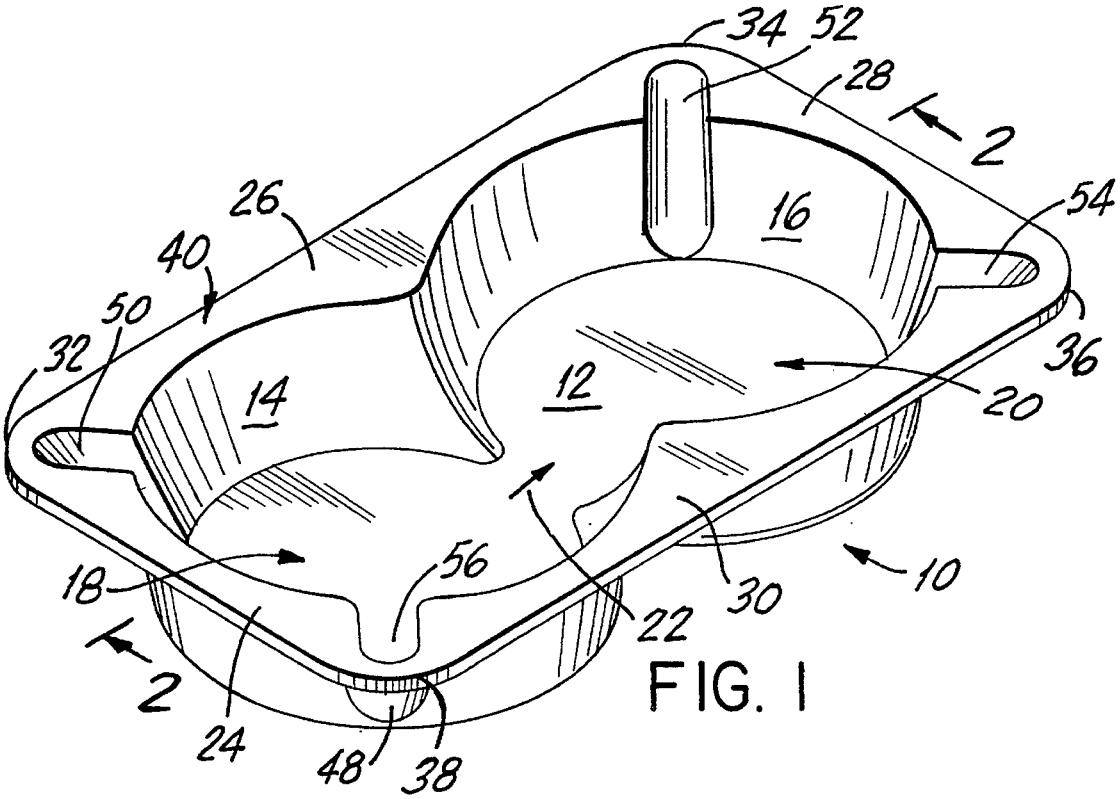
FIG. 1 is a perspective view of the plastic tray constructed in accordance with a first embodiment of the present invention.
Figure 2:
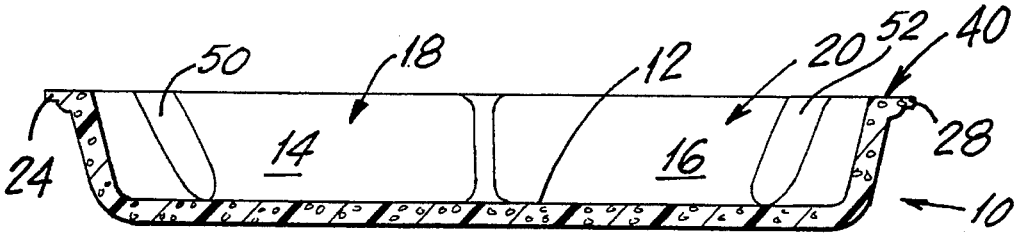
FIG. 2 is a sectional view taken along line 2—2 of FIG. 1.
Figure 3:
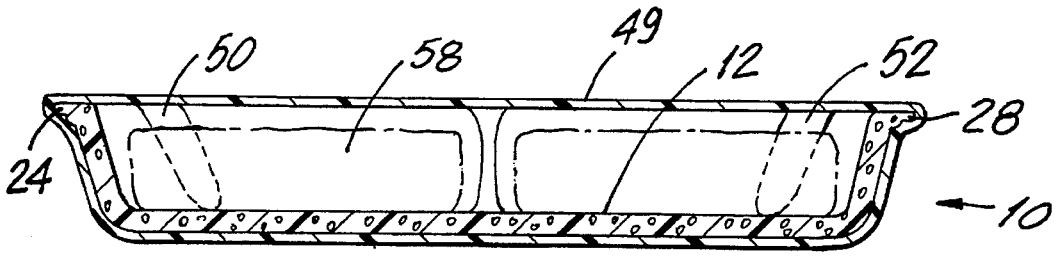
FIG. 3 is a view similar to FIG. 2 with the tray containing meat patties and being sealed with an overwrap of transparent film.
Figure 4:
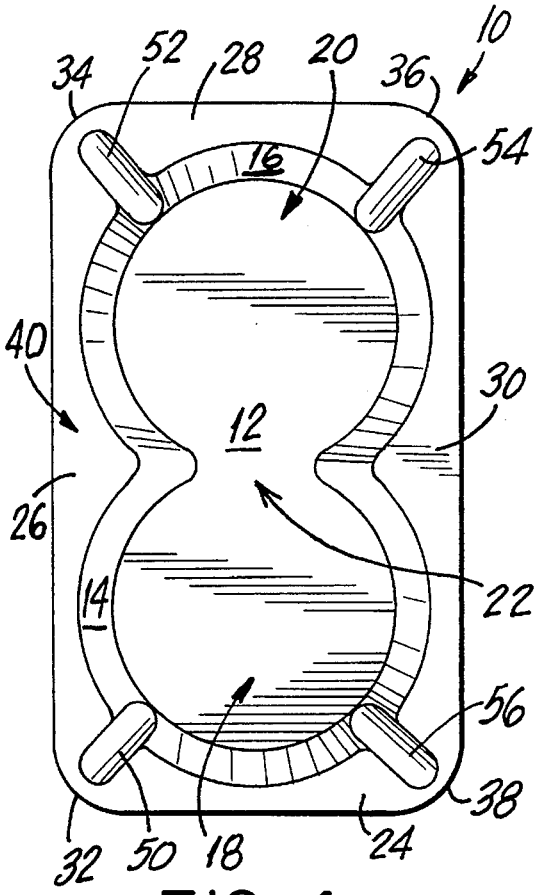
FIG. 4 is a top plan view of the plastic tray shown in FIG. 1.
Figure 5:
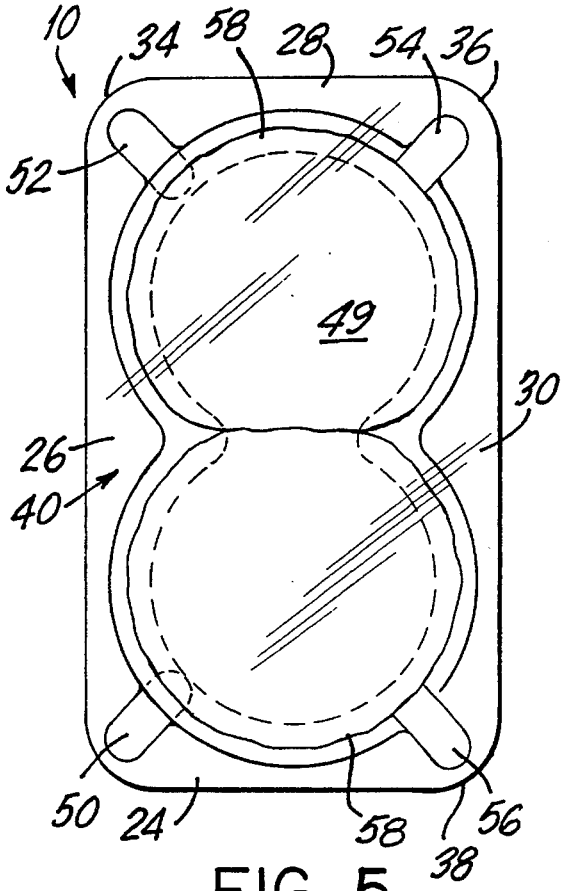
FIG. 5 is a view similar to FIG. 4 with the tray containing meat patties and being sealed with an overwrap of transparent film.
Figure 6:
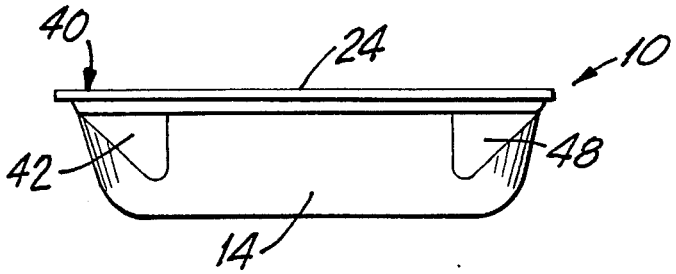
FIG. 6 is an end view of the tray shown in FIG. 4.
Figure 7:
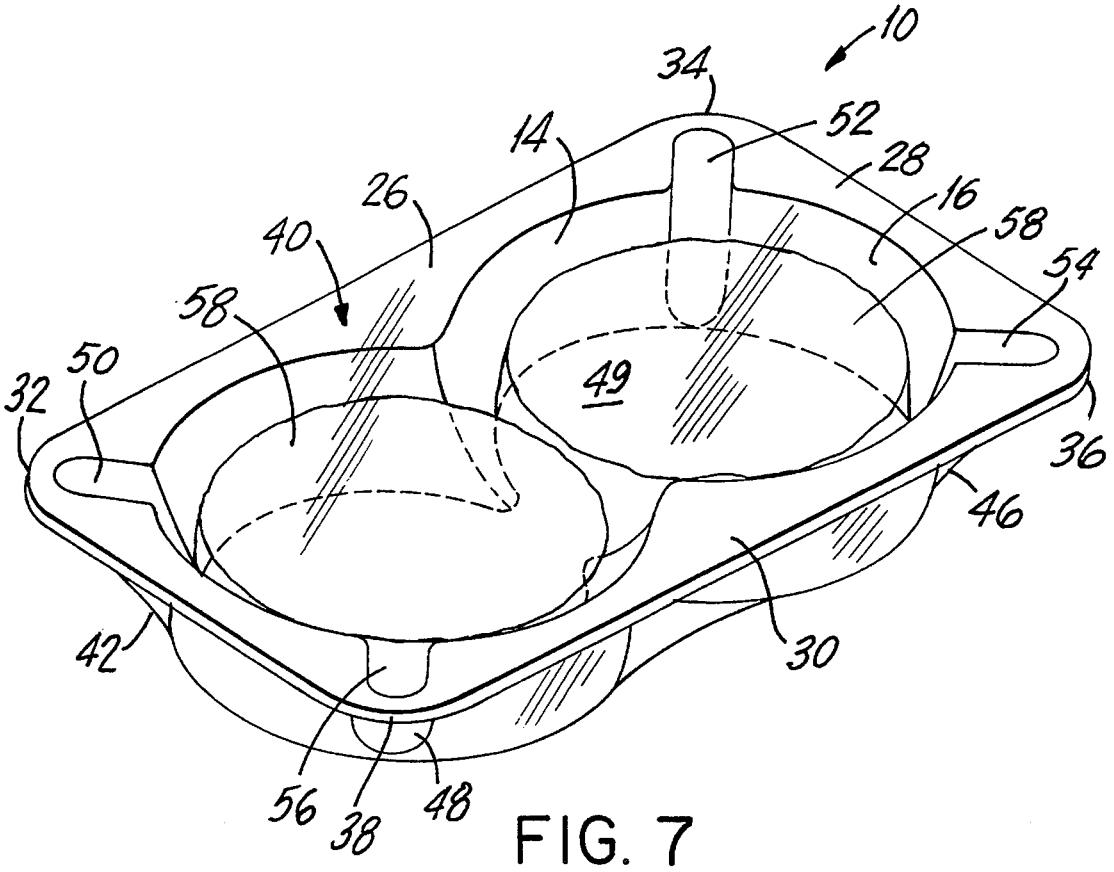
FIG. 7 is a view similar to FIG. 1 with the tray containing meat patties and being sealed with an overwrap of transparent film.

Referring to FIGS. 1 through 7, numeral 10 represents a plastic tray constructed in accordance with a first embodiment of the present invention. Tray 10 includes a base 12 connected to sidewalls 14 and 16. The base 12 and sidewalls 14 and 16 define cylindrically shaped food retaining chambers 18 and 20. Sidewalls 14 and 16 are outwardly bowed. Food retaining chambers 18 and 20 may be interconnected by communication channel 22.

Sidewalls 14 and 16 are connected to upper edges 24, 26, 28 and 30. Upper edges 24–30 are connected by radial corners 32, 34, 36 and 38 to form an upper surface 40 of tray 10. Corner reinforcing ribs 42, 44, 46 and 48 are positioned at radial corners 32–38, respectively, and connect the outer side of sidewalls 14 and 16 to the under side of radial corners 32–38. Corner reinforcing ribs 42–48 act to resist deflection of upper edges 24–30 during overwrapping with a tightly stretched transparent film 49. Corner reinforcing ribs 42–48 also support upper surface 40 when additional trays are stacked on top of tray 10.

Corner reinforcing ribs 42–48 may include access channels 50, 52, 54 and 56, respectively, to facilitate finger or utensil access to food 58 positioned within food retaining chambers 18 and 20. Upper edges 24–30 are widened at radial corners 32–38 to provide additional support.

Tray 10 is preferably molded from expanded polystyrene foam utilizing thermo-forming machinery and techniques well known in the art. The material should be sufficiently stiff or rigid to support meat products placed therein, and the stacking of such trays one on top of another, while, at the same time remaining resilient and flexible to prevent breakage and facilitate sealing of the overwrap film 49 used thereon. The arrangement is such that overwrap film 49 is supported by the upper surface 40 of tray 10 to minimize sagging of the overwrap 49 and prevent the overwrap 49 from coming into contact with food 58 in the food retaining chambers 18 and 20.

The thickness of base 12, sidewalls 14 and 16, and upper surface 40 may be approximately 0.210 inches (0,533 cm). At base 12, food retaining chambers 18 and 20 have a diameter of approximately 3.866 inches (9.820 cm). Access channels 50–56 are approximately 0.50 inches (1.27 cm) wide. Sidewalls 14 and 16 bow outwardly at an angle of approximately 15° from a vertical axis.

Tray 10 may be constructed in a variety of sizes. Preferably, the length of upper surface 40 is approximately 9.875 inches (25.083 cm) and the width of upper surface 40 is approximately 5.687 inches (14.445 cm). The depth of tray 10 may be approximately 1.50 inches (3.810 cm).

Typically, radial corners 32–38 have a radius of approximately 1.0 inch (2.54 cm). The connection between base 12 and sidewalls 14 and 16 may have a radius in the range from approximately 0.29 inches (0.737 cm) to approximately 0.50 inches (1.27 cm).

Figure 8:
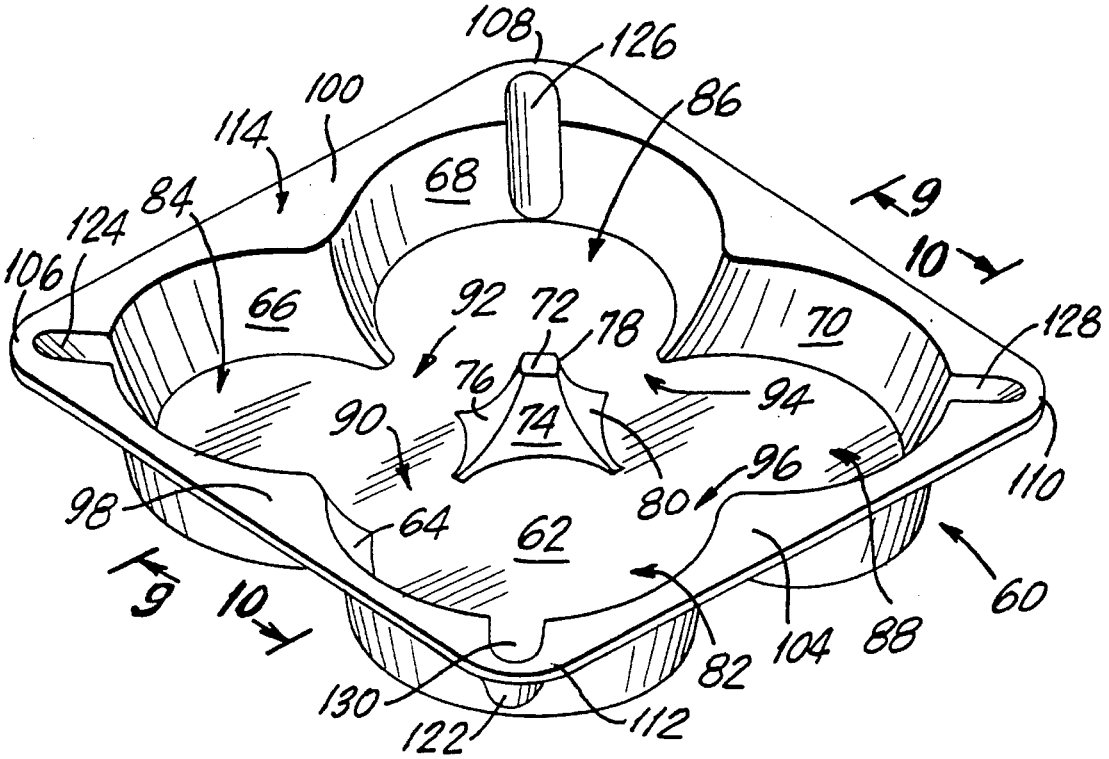
FIG. 8 is a perspective view of a plastic tray constructed in accordance with a second embodiment of the present invention.
Figure 9:
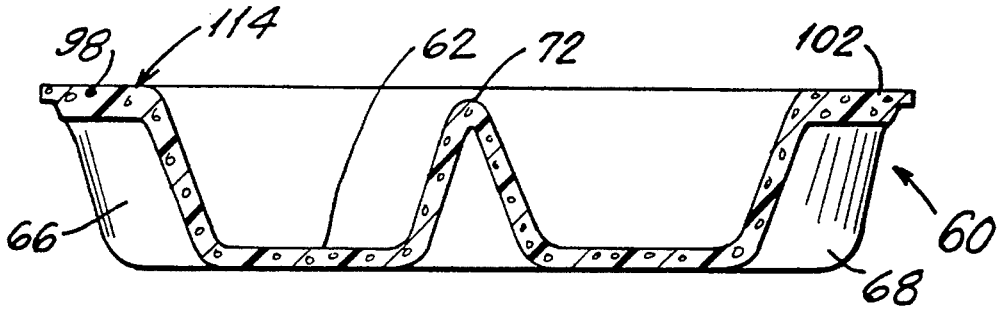
FIG. 9 is a sectional view taken along line 9—9 of FIG. 8.
Figure 10:
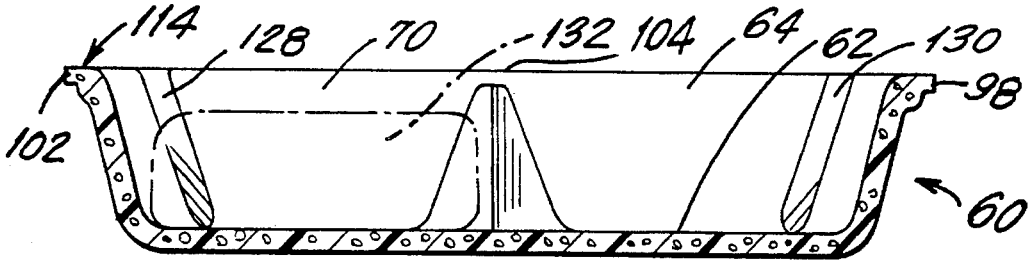
FIG. 10 is a sectional view taken along line 10—10 of FIG. 8 and illustrates a meat patty in phantom in one of the food retaining chambers.
Figure 11:
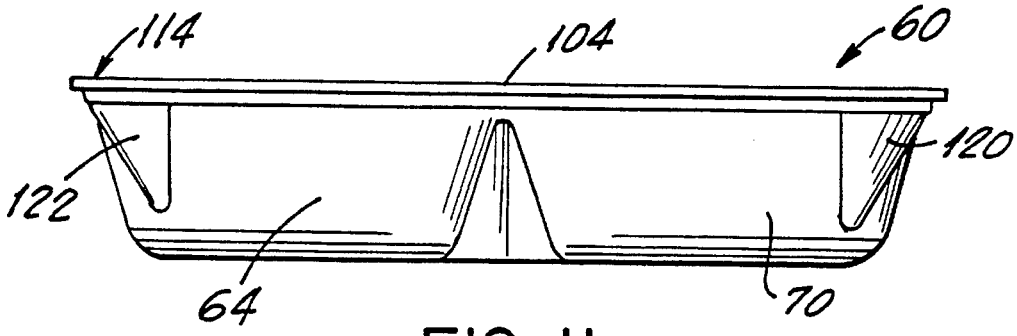
FIG. 11 is an end view of the plastic tray embodiment shown in FIG. 8; and, FIG. 12 is a view similar to FIG. 8 with the tray containing meat patties and being sealed with an overwrap of transparent film.
Figure 12:
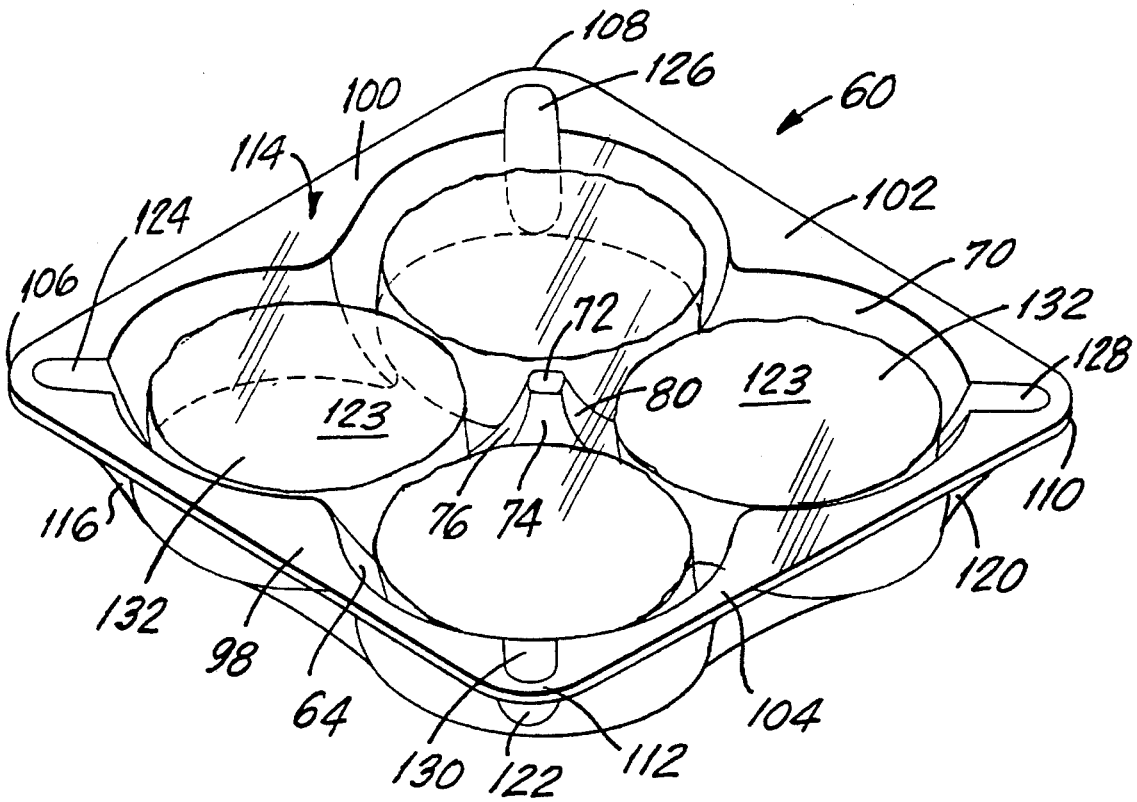

Referring to FIGS. 8 through 12, numeral 60 represents a plastic tray constructed in accordance with a second embodiment of the present invention.

Tray 60 includes a base 62 connected to sidewalls 64, 66, 68 and 70. Central post 72 is centrally located on base 62 and includes dividing walls 74, 76, 78 and 80. Food retaining chambers 82, 84, 86 and 88 are cylindrically shaped and defined by base 62, sidewalls 64–70, respectively, and dividing walls 74–80, respectively. Sidewalls 64–70 are outwardly bowed or sloped and dividing walls 74–80 are inwardly or centrally bowed or sloped at approximately the same angle. Food retaining chambers 82 and 84 may be interconnected by communication channel 90. Similarly, food retaining chambers 84 and 86, 86 and 88, and 88 and 82 may be interconnected by communication channels 92, 94 and 96, respectively.

Sidewalls 64–70 are connected to upper edges 98, 100, 102 and 104. Upper edges 98–104 are connected by radial corners 106, 108, 110 and 112 to form an upper surface 114 of tray 60. Post 72 extends upwardly from base 62 to a point substantially level with upper surface 114 of tray 60. Corner reinforcing ribs 116, 118, 120 and 122 are positioned at radial corners 106–112, respectively, and connect the outer side of sidewalls 64–70 to the under side of radial corners 106–112. Corner reinforcing ribs 116–122 act to resist deflection of upper edges 98–104 during overwrapping with a tightly stretched transparent film 123. Corner reinforcing ribs 116–122 also support upper surface 114 when additional trays are stacked on top of tray 60.

Corner reinforcing ribs 116–122 may include access channels 124, 126, 128 and 130, respectively, to facilitate finger or utensil access to food 132 positioned within food retaining chambers 84, 86, 88 and 82, respectively. Upper edges 98–104 are widened at radial corners 106–112 to provide enhanced support.

Tray 60 is preferably molded from expanded polystyrene foam utilizing thermo-forming machining and techniques well known in the art. The material should be sufficiently stiff or rigid to support meat products placed therein, and the stacking of such trays one on top of another, while, at the same time remaining resilient and flexible to prevent breakage and facilitate sealing of the overwrap film 123 used thereon. The arrangement is such that overwrap 123 is supported by upper surface 114 of tray 60 and the top of post 72 to minimize sagging of the overwrap 123 and prevent the overwrap from coming into contact with food 132 in the food retaining chambers 82–88.

The thickness of base 62, sidewalls 64–70, and upper surface 114 may be approximately 0.210 inches (0.533 cm). At base 62, food retaining chambers 82–88 have a diameter of approximately 3.866 inches (9.820 cm). Access channels 124–130 are approximately 0.50 inches (1.27 cm) wide. Sidewalls 64–70 bow outwardly or slope at an angle of approximately 15° from a vertical axis. Similarly, dividing walls 74–80 bow inwardly or slope at an angle of approximately 15° from a vertical axis.

Tray 60 may be constructed in a variety of sizes. Preferably, upper surface 114 is a square having sides measuring approximately 10.125 inches (25.718 cm). The depth of tray 60 may be approximately 2.0 inches (5.08 cm) .

Typically, radial corners 106–112 have a radius of approximately 1.0 inch (2.54 cm). The connection between base 62 and sidewalls 64–70 may have a radius in the range from approximately 0.29 inches (0.737 cm) to approximately 0.50 inches (1.27 cm).

While preferred embodiments of the invention have been shown and described in detail, it will be readily understood and appreciated that numerous omissions, changes, and additions may be made without departing from the spirit and scope of the invention. For example, in its simplest form, the invention includes a base, a sidewall, an upper surface and a reinforcing rib. The sidewall and base form a cylindrical food retaining chamber and the reinforcing rib connects the sidewall to the upper surface. The reinforcing rib also provides a channel which provides access to food positioned in the food retaining chamber.

What is claimed is:

1. A molded plastic overwrap tray comprising:

a base and sidewalls, each of said sidewalls having end edges and an upper edge, the upper edges of said sidewalls defining an upper surface of said tray;

said base and sidewalls defining a food retaining chamber;

adjacent end edges of adjacent sidewalls of said tray being connected to one another through a corner reinforcing rib;

each of said corner reinforcing ribs extending from said base to the upper edges of the associated sidewalls of said tray and being formed having a wall providing a corner channel in communication with said food retaining chamber;

the corner channel of each of said corner reinforcing ribs being of a size sufficient to permit finger access to food positioned in said food retaining chamber of said tray to facilitate removal thereof; and the wall of each of said corner reinforcing ribs further providing reinforcement to resist deflection of the upper edges of said sidewalls of said tray;

whereby an overwrap on said tray is supported by the upper surface of said tray to minimize sagging of the overwrap and prevent the overwrap from coming into contact with food in said food retaining chamber.

2. The plastic overwrap tray of claim 1 wherein:

the upper surface of said tray adjacent to the corner channels of said corner reinforcing ribs has a width sufficient to provide enhanced support surfaces at the corners of said tray.

3. The plastic overwrap tray of claim 1 wherein:

said sidewalls have an outer surface, and the upper surface of said tray extends outward beyond the outer surface of said sidewalls.

4. A molded plastic overwrap tray comprising:

a base and sidewalls, each of said sidewalls having end edges and an upper edge, the upper edges of said sidewalls defining the upper surface of said tray;

said base and sidewalls defining a plurality of food retaining chambers, said chambers being free of partitions between one another;

adjacent end edges of adjacent sidewalls of said tray being connected to one another through a corner reinforcing rib;

each of said corner reinforcing ribs extending from said base to the upper edges of the associated sidewalls of said tray and being formed having a wall providing a corner channel in communication with at least one of said food retaining chambers;

the corner channel of each of said corner reinforcing ribs being of a size sufficient to permit finger access to food positioned in the associated food retaining chamber of said tray to facilitate removal thereof; and the wall of each of said corner reinforcing ribs further providing reinforcement to resist deflection of the upper edges of said sidewalls of said tray;

whereby an overwrap on said tray is supported by the upper surface of said tray to minimize sagging of the overwrap and prevent the overwrap from coming into contact with food in said food retaining chambers.

5. The plastic overwrap tray of claim 4 further comprising:

a center post positioned between said food retaining chambers, said post extending from said base to a point substantially level with the upper surface of said tray; and said center post contacting the under surface of any overwrap on said tray to prevent contact between the food and the overwrap.

6. The plastic overwrap tray of claim 5 wherein:

each of said sidewalls has an inner surface that slopes outwardly from said base to the upper surface of said tray; and said center post slopes from said base to the upper surface of said tray, said post having a surface which faces an associated one of said chambers and slopes upwardly at approximately the same angle as does the inner surface of the sidewalls of the associated chamber.

7. The plastic overwrap tray of claim 5 wherein:

the upper surface of said tray adjacent to the corner channels of said corner reinforcing ribs has a width sufficient to provide enhanced support surfaces at the corners of said tray.

8. The plastic overwrap tray of claim 5 wherein:

said sidewalls have an outer surface, and the upper surface of said tray extends outward beyond the outer surface of said sidewalls.

9. The plastic overwrap tray of claim 4 wherein:

the upper surface of said tray adjacent to the corner channels of said corner reinforcing ribs has a width sufficient to provide enhanced support surfaces at the corners of said tray.

10. The plastic overwrap tray of claim 4 wherein:

said sidewalls have an outer surface, and the upper surface of said tray extends outward beyond the outer surface of said sidewalls.

* * * * *